US010480515B2

(12) United States Patent
Springer et al.

(10) Patent No.: US 10,480,515 B2
(45) Date of Patent: Nov. 19, 2019

(54) PERFORMANCE MAP CONTROL OF CENTRIFUGAL PUMPS

(71) Applicant: ORCAN ENERGY AG, München (DE)

(72) Inventors: Jens-Patrick Springer, München (DE); Andreas Grill, München (DE); Richard Aumann, München (DE); Andreas Schuster, München (DE)

(73) Assignee: ORCAN ENERGY AG, München (DE)

( * ) Notice: Subject to any disclaimer, the term of this patent is extended or adjusted under 35 U.S.C. 154(b) by 794 days.

(21) Appl. No.: 14/911,925

(22) PCT Filed: Jun. 27, 2014

(86) PCT No.: PCT/EP2014/063657

§ 371 (c)(1),
(2) Date: Feb. 12, 2016

(87) PCT Pub. No.: WO2015/022113

PCT Pub. Date: Feb. 19, 2015

(65) Prior Publication Data

US 2016/0195092 A1 Jul. 7, 2016

(30) Foreign Application Priority Data

Aug. 14, 2013 (EP) ..... 13180356

(51) Int. Cl.
*F04D 15/00* (2006.01)
*F01K 13/02* (2006.01)
(Continued)

(52) U.S. Cl.
CPC ..... *F04D 15/0027* (2013.01); *F04D 1/00* (2013.01); *F04D 15/0066* (2013.01); *F04D 29/4206* (2013.01)

(58) Field of Classification Search
CPC .... F04D 15/0027; F04D 15/0066; F04D 1/00; F04D 29/4206; F04D 15/00; F01K 25/00; F01K 25/08; F01K 13/02
See application file for complete search history.

(56) References Cited

U.S. PATENT DOCUMENTS 4,108,574 A * 8/1978 Bartley ..... G01F 1/00 417/19
5,006,044 A * 4/1991 Walker, Sr. ..... E21B 47/0008 417/12

(Continued)

FOREIGN PATENT DOCUMENTS

CN 101556068 A 10/2009
CN 201461354 U 5/2010

(Continued)

OTHER PUBLICATIONS

Chinese Office Action issued by the State Intellectual Property Office of People's Republic of China dated Oct. 9, 2016, for Chinese Patent Application No. 201480051136.3.

(Continued)

*Primary Examiner* — Justin D Seabe
*Assistant Examiner* — Joshua R Beebe
(74) *Attorney, Agent, or Firm* — Moore & Van Allen PLLC; Henry B. Ward, III

(57) ABSTRACT

The present invention relates to a method for controlling a pump, in particular a centrifugal pump, during pumping of a liquid, comprising the following steps: fixing a setpoint value of a flow rate of the pump; measuring an inlet pressure of the liquid upstream of the pump and an outlet pressure of the liquid downstream of the pump; determining a setpoint value of a rotational speed of the pump from a performance map of the pump, wherein the fixed setpoint value of the flow rate and a difference between the outlet pressure and the inlet pressure are incorporated into the performance map as (Continued)

input values; and setting the rotational speed of the pump to the setpoint value of the rotational speed. Furthermore, the invention relates to a corresponding device for controlling a pump.

20 Claims, 7 Drawing Sheets

(51) Int. Cl.
*F04D 1/00* (2006.01)
*F04D 29/42* (2006.01)

(56) References Cited

U.S. PATENT DOCUMENTS 5,240,380 A * 8/1993 Mabe ..... F04D 15/0066 417/43
6,425,293 B1 * 7/2002 Woodroffe ..... G01F 23/0076 73/708
6,464,464 B2 * 10/2002 Sabini ..... F04D 15/0066 318/432
2008/0288115 A1 * 11/2008 Rusnak ..... F04D 15/0066 700/282
2009/0277400 A1 * 11/2009 Conry ..... F01N 5/02 123/2

FOREIGN PATENT DOCUMENTS

CN 102094798 A 6/2011
DE 10 2011115244 A1 9/2011
EP 1 286 056 A1 2/2003
EP 1323986 A1 7/2003
JP 2003267191 A 9/2003

OTHER PUBLICATIONS

European Patent Office. International Search Report dated Oct. 9, 2014. International Application No. PCT/EP2014/063657. Name of Applicant: Orcan Energy AG. English Language. 4 pages.
European Patent Office. Extended International Search Report dated Feb. 7, 2014. Corresponding European Patent Application No. EP 13 18 0356. Name of Applicant: Orcan Energy GmbH. English and German Language. 3 pages.

* cited by examiner

PERFORMANCE MAP CONTROL OF CENTRIFUGAL PUMPS

FIELD OF THE INVENTION

The present invention relates to a method for controlling a pump, in particular a centrifugal pump, during pumping of a liquid and to a corresponding device.

PRIOR ART

In centrifugal pumps the delivery amount is highly dependent on the differential pressure applied and on the rotational speed. To be exact, a difference between the liquid pressure on the pump outlet side and the liquid pressure on the pump inlet side determines the flow amount (mass flow or volume flow). Each pump has a pump performance map which is characteristic thereof and which defines a relation between the three parameters (difference between the liquid pressure on the pump outlet side and the liquid pressure on the pump inlet side, flow amount, rotational speed). When two of the parameters are known, it is thus possible to determine the third parameter from the performance map. The performance map may provided be in the form of empirical, semi-empirical or theoretical model equations. In empirical model equations, empirically ascertained values may be related to compensating functions. These empirical compensating functions may also be recorded as a representation in a table. In the case of semi-empirical model equations, empirically ascertained values as well as physical equations describing e.g. relations of physical parameters are taken into consideration. In the case of theoretical model equations, the relations of the parameters are fully described by physical equations.

The above is disadvantageous insofar as fluctuations in the media pressure on the high and/or low pressure side cause a non-uniform flow (at a given rotational speed), a circumstance that may impair the process cycle in mass flow critical processes. Furthermore, the performance map reduces the operating range of the pump, and this may lead to process failures and component damage, if the respective limits are exceeded.

FIG. 1 shows an example of such a performance map. The pumping head H is here plotted against the volume flow Q as a function of the rotational speed n. The volume flow is limited by a minimum and a maximum value of the performance map. In addition, there is a maximum pumping head that can only be achieved at maximum rotational speed and minimum flow. It turns out that, at a fixed rotational speed, the change of flow is highly dependent on the head. Since the pumping head is proportional to the differential pressure applied to the pump, pressure fluctuations on the high or low pressure side will cause a change in the pump flow rate. The downward limitation of the volume flow need not be constant, as in the case of the drawing, but may depend on the rotational speed.

The example in FIG. 2 shows a reduction of the pumping head from $H_1$ to $H_2$ at a constant rotational speed n. The map behavior leads to a significant increase in the flow from $Q_1$ to $Q_2$. Such changes may cause problems in process operation, which may result in malfunction, downtimes and defects. In addition, changes of flow are desired in many processes independently of the current pumping head. Also this function is impaired by the influence of the performance map. If, for example, the flow is to be augmented and if the rotational speed is increased to this end, the higher delivery amount may lead to an increase in pressure on the high pressure side in many processes, and this increase in pressure partly compensates the higher flow rate due to the influence of the performance map.

Furthermore, the performance map also shows that there are machine-specific restrictions of pump operation (such as a minimum volume flow), which have to be observed for continuously guaranteeing the machine function.

Document DE 10 2011 115 244 A1 only discloses a monitoring of the operating condition of a pump, said monitoring comprising a comparison between an actual characteristic curve and a desired characteristic curve of the pump for predicting therefrom a need for repair or replacement of the pump.

One field of use in which the save delivery of a liquid stream is of particular importance is the pump control of a feed pump of an ORC power plant process (Organic Rankine Cycle), of the type schematically shown in FIG. 3. Here, a pump (P) is controlled such that desired live steam parameters at the outlet of a heat exchanger (V) downstream of the pump can reliably be set. To this end, the rotational speed of the pump is influenced by control such that, via the thus changed flow rate, the evaporation conditions will change such that the desired pressures and temperatures of the live steam are accomplished and controlled to assume stable values for a stable process operation.

In this example, the pumping head of the pump depends on the live steam pressure ($p_{FD}$) on the one hand and on the pressure level upstream of the pump ($p_{COND}$) on the other. This pressure depends on the current condensation pressure of the condenser (K) preceding the pump. In the ORC process, this condenser cools and liquefies the working medium by giving off heat to a cooling medium. This cooling medium (e.g. water of a heating network or ambient air) may be subjected to fluctuations as regards quantity and temperature (temperature fluctuations in a heating network, wind or other environmental influences). These fluctuations influence the heat transfer in the condenser and this has an effect on the condensation conditions and thus on the condensation pressure. Hence, extraneous disturbances may affect the pumping head of the pump and may thus cause fluctuations in the mass flow and in the live steam pressure. These potential fluctuation amplitudes have to be taken into account in safety considerations and availability analyses. In addition, the ORC process is a closed system and, consequently, it cannot be excluded that, via the expander (E), there will be a retroactive effect of a fluctuating live steam pressure on the condensation pressure. This may result in a self-reinforcing effect that will negatively influence the process stability still further.

One possibility of countering these influences is the use of a cascade control according to FIG. 4. Here, an inner control circuit controls the flow rate on the basis of a comparison between a current actual value and a setpoint value of the mass flow or the volume flow, while an outer control circuit specifies for the inner circuit the setpoint flow rate for control to the real control variable of the pump (e.g. the process pressure). In this way, flow deviations can be compensated and simultaneously controlled to a desired process value.

In the cascade controller the (inner) subprocess I may be the pumping process. All the components that convert the signal of the mass flow control (m control) into the conveyance of a medium are here comprised. This may include a control/rotational speed control of the pump, the pump motor and the pump itself. The outer subprocess II may e.g. be an evaporation process and the process value s may be the media pressure p after evaporation. The evaporation process may thus comprise all the necessary components, such as one or more heat exchangers, tanks, fittings, and the like.

Although this solution allows to detect flow deviations when they occur and to react thereto, this is only possible if the flow rate already deviates from its setpoint value $S_{set}$. An anticipatory compensation prior to occurrence of the fluctuations is therefore impossible. Hence, an additional disturbance feedforward control is required (not shown). In addition, this prior art solution necessitates a complicated and often cost-intensive measurement of the mass flow or the volume flow. Avoiding this measurement would have significant cost benefits.

DESCRIPTION OF THE INVENTION

It is the object of the present invention to overcome the above described drawbacks at least partially.

This object is achieved by a method according to claim 1.

The method according to the present invention, used for controlling a pump, in particular a centrifugal pump, during pumping of a liquid, comprises the following steps: fixing a setpoint value of a flow rate of the pump; measuring an inlet pressure of the liquid upstream of the pump and an outlet pressure of the liquid downstream of the pump; determining a setpoint value of a rotational speed of the pump or a control signal determining the rotational speed from a performance map of the pump, wherein the fixed setpoint value of the flow rate and a difference between the outlet pressure and the inlet pressure are incorporated into the performance map as input values; and setting the rotational speed of the pump to the setpoint value of the rotational speed or supplying the speed-determining control signal to the pump.

The above is advantageous insofar as, due to the fact that the performance map is taken into consideration, no measurement of the mass flow or of the volume flow is required for the purpose of control and compensation. Furthermore, the control will already be able to react when a pressure fluctuation occurs, before the effects caused by a flow fluctuation appear, (anticipatory control behavior), so that the control performance will be improved.

The performance map of the pump can here be used in its conventional form, where a relation between the flow rate and the differential pressure or the pumping head is given at different rotational speeds, each of said rotational speeds being, however, constant.

The performance map may, alternatively or additionally, be used in an "inverted" form (hereinafter also referred to as inverted performance map), a relation being then given between the differential pressure or the pumping head and the rotational speed in the case of different flow rates, each of said flow rates being, however, constant.

In any case, the performance map is used such that a change in the flow rate caused by a change in the differential pressure is countered by controlling the rotational speed such that it will change so as to maintain the flow rate as constant as possible, this being accomplished by ascertaining a respective operating point of the pump in its performance map or in its inverted performance map.

The setpoint value of the flow rate may here again be fixed by the control, e.g. based on a fixed outlet pressure of the pump or based on some other suitable process value. On the other hand, the setpoint value of the flow rate may be fixed by a user. In both cases, this may be done either by directly setting the flow rate or, indirectly, by setting the rotational speed, which will then allow to ascertain the flow rate that is to be maintained constant.

According to a preferred embodiment, the steps of measuring the inlet pressure of the liquid and the outlet pressure of the liquid, determining the setpoint value of the rotational speed of the pump and setting the rotational speed of the pump are carried out continuously after fixing the setpoint value of the flow rate.

According to a further development, the fixing of the setpoint value of the flow rate may comprise the following steps: determining a time average value of the difference between the outlet pressure and the inlet pressure; and fixing the setpoint value of the flow rate from the performance map of the pump, the time average value of the difference between the outlet pressure and the inlet pressure as well as a current rotational speed of the pump being incorporated in the performance map as input values. In this way, a setpoint value of the flow rate that should be observed to the best possible extent can be determined during operation of the pump. Also the fixing of the setpoint value of the flow rate may be carried out continuously in this case.

Another further development consists in that the time average value of the difference between the outlet pressure and the inlet pressure can be determined from a first time average value of the inlet pressure and a second time average value of the outlet pressure. If necessary, it is thus possible to use different time constants for averaging the inlet pressure and the outlet pressure.

According to another further development, the determination of the setpoint value of the rotational speed of the pump may comprise the following additional steps: checking whether a combination of the rotational speed of the pump, the fixed setpoint value of the flow rate and the difference between the outlet pressure and the inlet pressure lies within a performance map limit; setting the rotational speed of the pump to the setpoint value of the rotational speed, if the combination lies within the performance map; and setting the rotational speed of the pump to a safety value, if the combination lies outside the performance map, the safety value being preferably chosen such that the deviation from the setpoint value of the flow rate is as small as possible.

According to another further development, setting the rotational speed of the pump to the setpoint value of the rotational speed may comprise the output of a correction signal onto a control signal supplied to the pump. In this way, a correction signal can be superimposed on the control signal. In particular, a minimum control signal can be outputted as a correction signal so as to avoid setting of an operating condition outside of the performance map.

Another further development consists in that the performance map defines at various rotational speeds a relation between the flow rate and a pumping head of the pump, and in that the pumping head is determined from the differential pressure between the measured outlet pressure and the measured inlet pressure. In particular, the pumping head h can be determined from $h=(p_2-p_1)/(\rho\sim g)$, where $p_1$ stands for the measured inlet pressure, $p_2$ for the measured outlet pressure, $\rho$ for the density of the liquid, and g is the standard acceleration due to gravity.

According to another further development, the density of the liquid may be used as a constant predetermined value, or the method may comprise the additional step of measuring the temperature of the liquid, and the density of the liquid may be ascertained from a functional dependence of the density on the temperature or from a table. The measuring of the temperature may here especially comprise averaging of the temperature over a predetermined time interval.

According to another further development, the inlet pressure and the outlet pressure may be measured continuously. This allows a constant correction of the rotational speed in the case of pressure fluctuations.

The flow rate can be defined as a volume flow or as a mass flow of the liquid through the pump.

The above-mentioned object is additionally achieved by a device according to claim 10.

The device according to the present invention used for controlling a pump, in particular a centrifugal pump, during pumping of a liquid, comprises: a first pressure meter for measuring an inlet pressure of the liquid upstream of the pump; a second pressure meter for measuring an outlet pressure of the liquid downstream of the pump; and a control unit for fixing a setpoint value of a flow rate of the pump; for determining a setpoint value of a rotational speed of the pump from a pump performance map stored in a memory, wherein the fixed setpoint value of the flow rate and a difference between the outlet pressure and the inlet pressure are incorporated into the performance map as input values; and for setting the rotational speed of the pump to the setpoint value of the rotational speed. The advantages correspond to those specified in connection with the method according to the present invention. In addition, the device according to the present invention may configured such that it is suitable for carrying out the method according to the present invention or one of the further developments thereof.

According to a further development, the control unit may also be suitable for determining a time average value of the difference between the outlet pressure and the inlet pressure; and for fixing the setpoint value of the flow rate from the performance map of the pump, wherein the time average value of the difference between the outlet pressure and the inlet pressure as well as a current rotational speed of the pump are incorporated into the performance map as input values.

Another further development consists in that the control unit may be configured for outputting a control signal to the pump, and in that the setting of the rotational speed of the pump to the setpoint value of the rotational speed may comprise the output of a correction signal onto the control signal supplied to the pump.

According to a further development, the performance map may define a relation between the flow rate and a pumping head of the pump at various rotational speeds, and the control unit may additionally be configured for determining a pumping head H from $H=(p_2-p_1)/(\rho\cdot g)$, where $p_1$ stands for the measured inlet pressure, $p_2$ for the measured outlet pressure, ρ for the density of the liquid, and g is the standard acceleration due to gravity.

Another further development consists in that the device may additionally comprise: a temperature measuring device for measuring a temperature of the liquid and for transmitting a temperature measurement signal to the control unit; wherein the control unit may additionally be configured for determining a density of the liquid from the temperature measurement signal and for ascertaining the density of the liquid from a functional dependence of the density on the temperature or from a table stored in the memory.

The device according to the present invention or one of the further developments thereof may be part of an ORC system (Organic Rankine Cycle) including a pump for pumping a working medium of the ORC system.

The further developments of the device according to the present invention and the advantages thereof correspond to those specified in connection with the method according to the present invention.

Additional features and exemplary embodiments as well as advantages of the present invention will be explained in more detail hereinafter with reference to the drawings. It goes without saying that the embodiments do not exhaust the scope of the present invention. It also goes without saying that some or all of the features described hereinafter may also be combined with one another in other ways.

DRAWINGS

EMBODIMENTS

Figure 1:
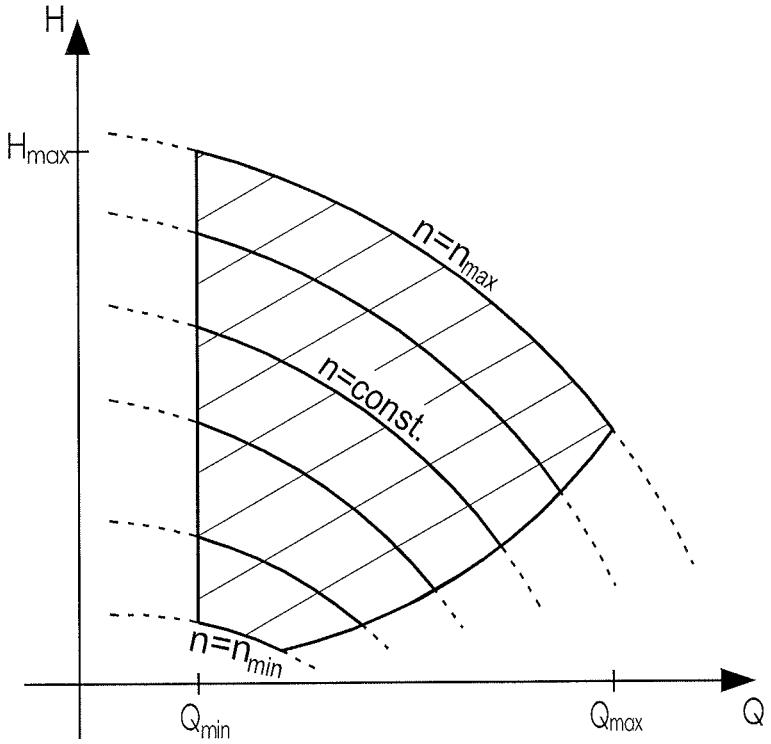
FIG. 1 shows schematically a performance map of a pump.
Figure 2:
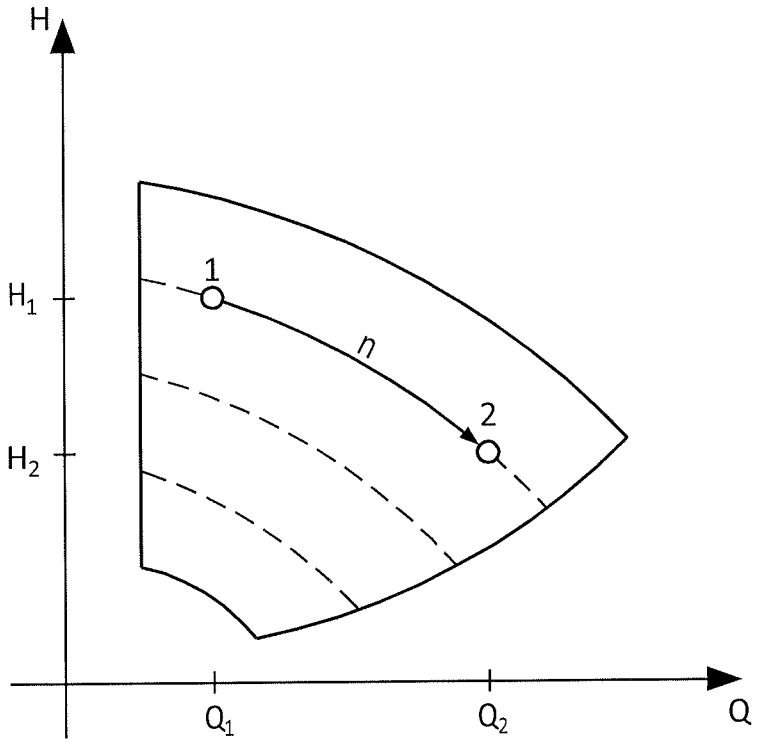
FIG. 2 shows the change of the flow rate in the case of a change of pressure and a constant rotational speed in the performance map of FIG. 1.
Figure 3:
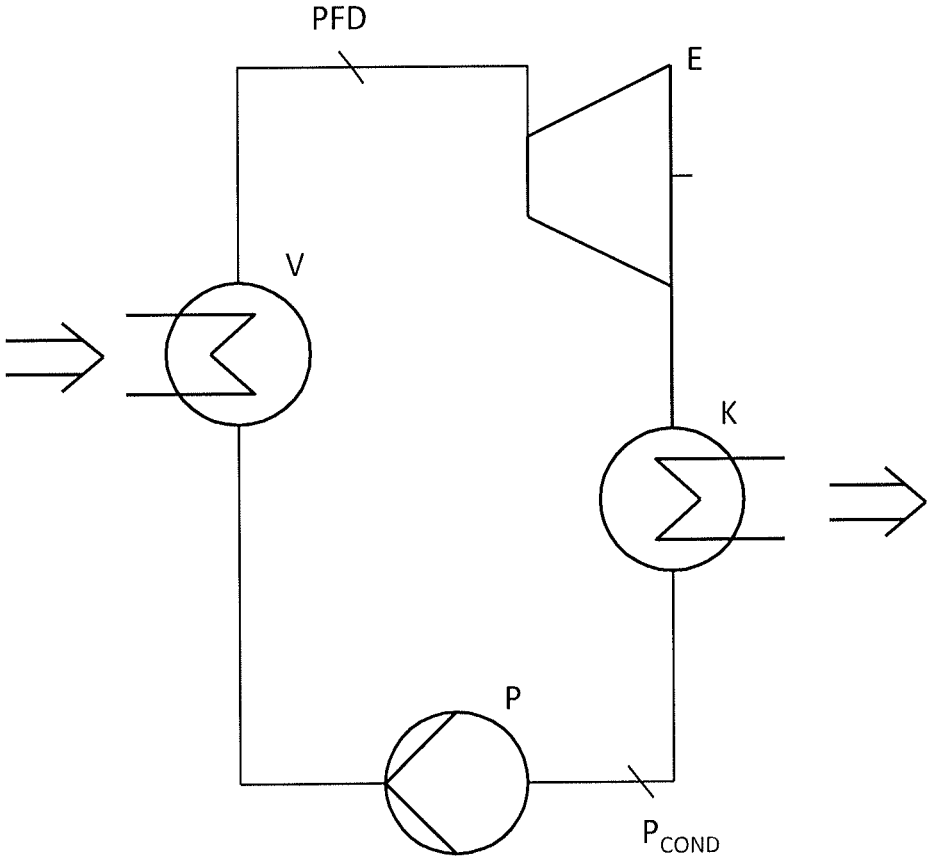
FIG. 3 shows the essential elements of an ORC system.
Figure 4:
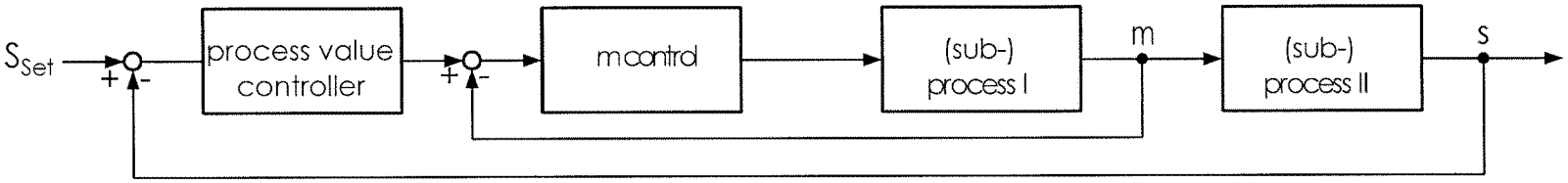
FIG. 4 shows a cascade controller.
Figure 5:
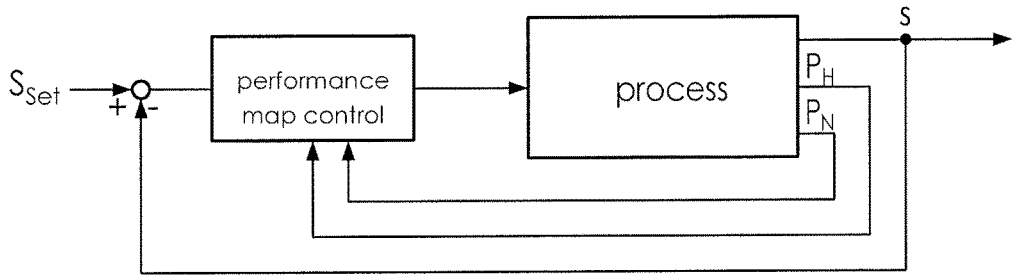
FIG. 5 shows the mode of operation of an embodiment of the performance map control according to the present invention.

FIG. 5 illustrates the method according to an embodiment disclosed in the present invention. The knowledge of the performance map of a machine allows to implement in the control (performance map control) the machine limitation with respect to the parameters of a process (difference between the liquid pressure on the pump outlet side and the liquid pressure on the pump inlet side, flow rate, rotational speed) and the parameter interdependence. A control algorithm monitors here the current pumping head (and the differential pressure, respectively) as well as the rotational speed and calculates therefrom the current flow rate. To this end, the performance map is stored numerically in the algorithm.

For ascertaining the pumping head for the control, it is necessary to know the current pressures on the low and high pressure sides ($p_n$, $p_h$) of the pump (i.e.: inlet pressure $p_1$ and outlet pressure $p_2$ measured on the inlet side and on the outlet side of the pump and upstream and downstream of the pump, respectively). The pumping head H can be calculated from the difference $\Delta p=(p_h-p_n)$ between these pressures and the density ρ of the medium:

$$H=\Delta p/(\rho\sim g)$$

where g stands for the standard acceleration due to gravity.

The current density may either be determined precisely by an additional measurement of the temperature of the medium, or it may, through an approximation, be assumed to be constant in the operating range used. The latter simplification is admissible for many media in a liquid phase and in the case of a limited operating range (pressure and/or temperature range) in an approximation that is sufficiently good for the control.

A setpoint value of a flow rate of the pump is set as the currently calculated flow rate; an inlet pressure of the liquid is measured upstream of the pump and an outlet pressure of the liquid is measured downstream of the pump; a setpoint value of a rotational speed of the pump is determined from the performance map of the pump, the fixed setpoint value of the flow rate and the difference between the outlet pressure and the inlet pressure being incorporated into the performance map as input values; and, finally, the rotational speed of the pump is set to the setpoint value of the flow rate. It follows that a change in the differential pressure will cause a change in the rotational speed so as to counter a change in the flow rate, which would otherwise occur. The change in the flow rate can at least be reduced.

In addition, the limitation of the performance map (e.g. minimum flow) is taken into account in the algorithm. A uniform process operation as well as compliance with the operating limits of the pump can be guaranteed in this way.

Figure 6:
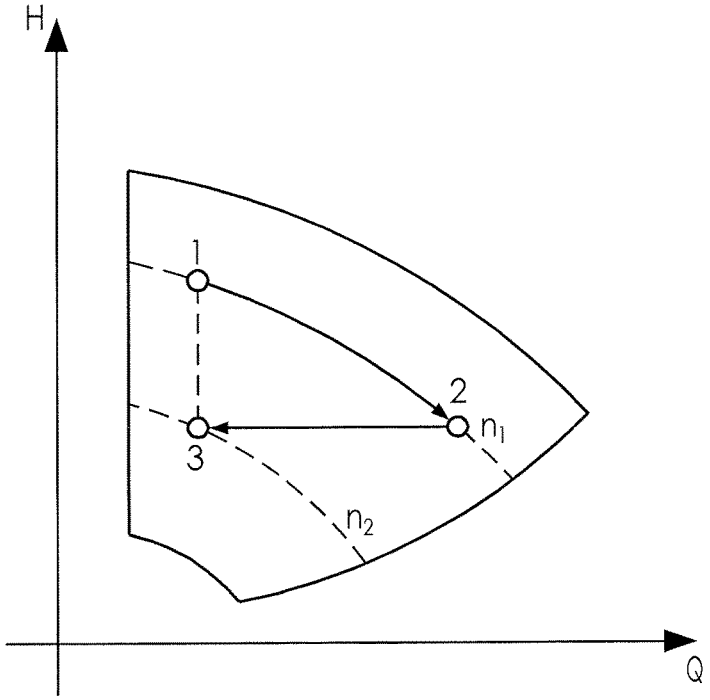
FIG. 6 shows a compensation of the flow rate in the case of fluctuations of the differential pressure in the performance map of the pump.

FIG. 6 shows the functionality of the compensation influence of the performance map control, viz. the correction of the rotational speed in response to a differential pressure change for correcting the flow rate in this way. The mode of operation of the method according to this embodiment of the performance map control according to the present invention is shown in the performance map of the pump. If, at a constant rotational speed $n_1$, the differential pressure or the corresponding pumping head decreases from that at point 1 to that at point 2, there will be an increase in the flow rate Q. By reducing the rotational speed to $n_2$, the original flow rate can be reestablished at point 3 in the case of the new differential pressure or pumping head.

Figure 7:
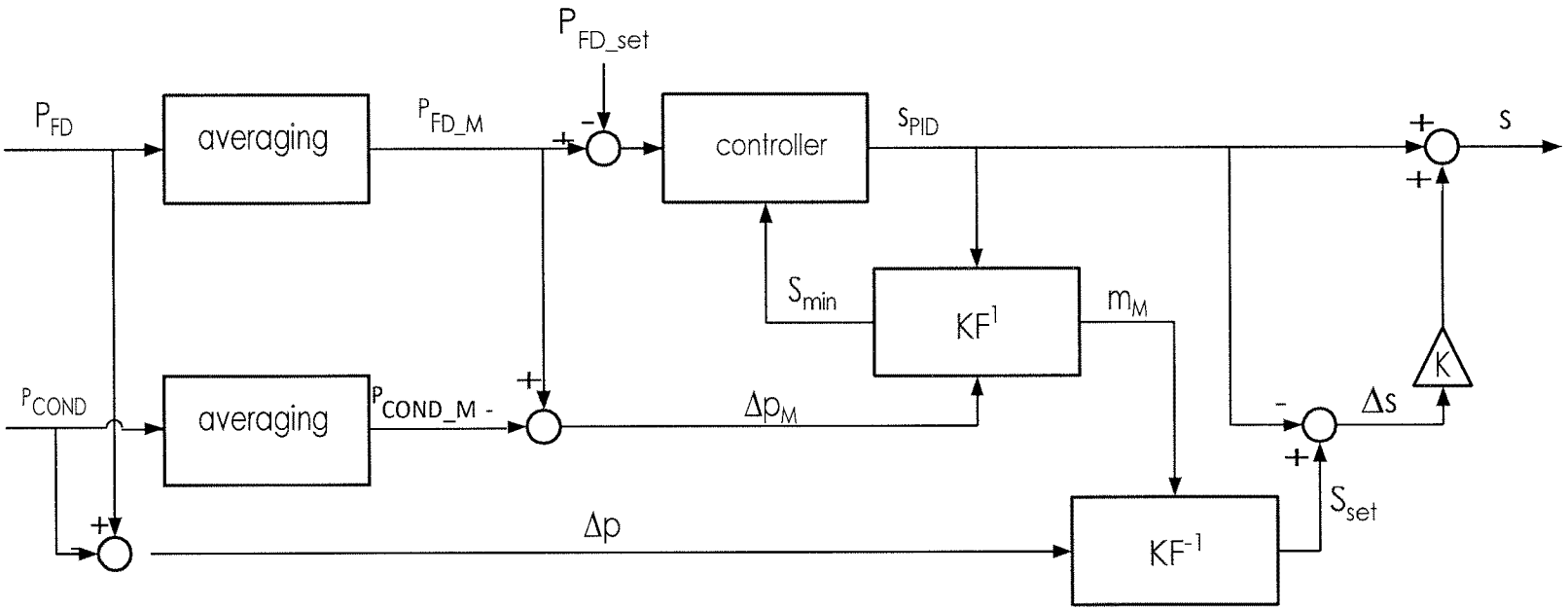
FIG. 7 shows a further embodiment of the performance map control according to the present invention.

Referring again to the above-mentioned example of an ORC process, the measurement values $p_{FD}$ and $p_{COND}$ (as high pressure and low pressure) are incorporated into the control according to the present invention (cf. FIG. 7). For suppressing the measurement of cyclical fluctuations, the measurement signal is first subjected to averaging (moving average) in a suitable averaging interval. The average value of the live steam pressure $p_{FD_M}$ is used with the live steam setpoint value concerning the control deviation as an input signal of a controller (e.g. a PID controller). The output signal and the difference between the average values are incorporated as input values into the performance map $KF^1$, where the currently expected mass flow is calculated. This value as well as the difference of the unaveraged current measurement values are incorporated into the inverted performance map $KF^{-1}$. The latter provides the currently necessary pump control signal. The difference between this value and the current control signal of the controller is the searched-for deviation to be compensated. By adding this deviation onto the control signal, a superimposition of the compensation of the disturbance is obtained. Through the gain K, the influence of this superimposition can be adapted to the process.

In this example, the performance map $KF^1$ also supplies to the controller the currently necessary minimum control signal $s_{min}$. The controller can thus be prevented from falling below this performance map limit.

A significant advantage of this approach is offered by the anticipatory operating principle of this control. The flow rate fluctuation is already compensated upon occurrence of pressure fluctuations (which cause mass flow changes and the resultant disturbances), before a downstream measurement system or the subsequent process could be able to detect the deviation and register the effects thereof. By measuring the pressures instead of the flow, the performance map control implicitly realizes also the function of a disturbance feedforward control.

Figure 8:
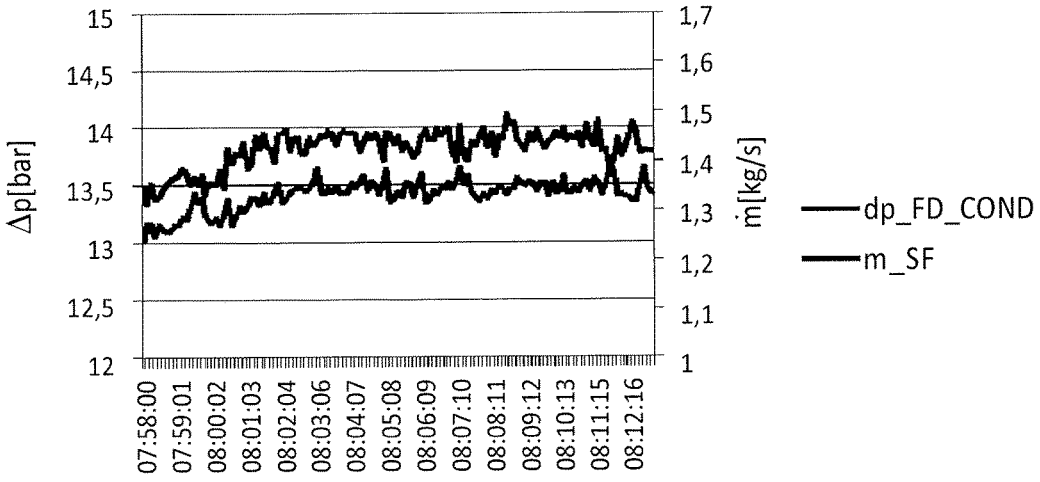
FIG. 8 shows, exemplarily, a differential pressure and a corresponding mass flow in an ORC system.

FIG. 8 shows exemplarily, on the basis of a measurement at an ORC system, the profile of the differential pressure ($p_{FD}$-$P_{COND}$) (upper curve in FIG. 8) and of the mass flow (lower curve in FIG. 8) over a period of approx. 15 minutes. It can be seen how pressure fluctuations show their influence on the flow rate. When the differential pressure decreases, a higher flow rate is immediately measurable, and vice versa.

Figure 9:
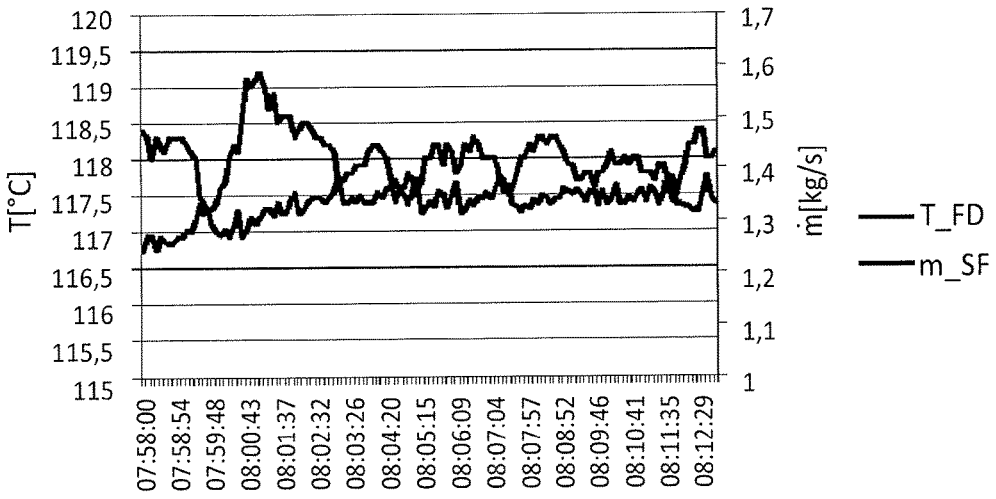
FIG. 9 shows the mass flow according to FIG. 8 and a corresponding steam temperature in the ORC system.

In addition, also the effect on an evaporation process is measurable (cf. FIG. 9). Here, the temperature of the steam (upper curve in FIG. 9) decreases in response to an increase in the mass flow (lower curve in FIG. 9), since the power transmitted in the heat exchanger must now vaporize and superheat a higher mass flow. Therefore, the steam temperature decreases. When the flow rate decreases, the temperature will increase again. Hence, it can be seen that a reduction of the flow fluctuations can lead to a stabilization of process parameters.

The performance map control allows this stabilization to be realized. The effects of the stabilization on the structural design and the process can be a higher process quality and availability as well as a higher reliability of observing process limit values. For example, if the temperature oscillations to be expected are not so high, the safety limits may be reduced in accordance with the now lower peak values and the process can be performed at higher temperatures (closer to the safety limits) without the availability being reduced in any way.

In addition, this control only requires two comparatively economy-priced pressure measuring points, which are already available in many processes, instead of the expensive mass flow or volume flow measurement. A significant cost advantage of performance map control in comparison with conventional approaches is obtained in this way.

The embodiments shown are only exemplary and the full scope of the present invention is defined by the claims.

The invention claimed is:

1. A method for controlling a pump during pumping of working medium in an Organic Rankine Cycle (ORC) system, comprising the following steps:

fixing a setpoint value of a flow rate of the pump, the pump pumping the working medium to a heat exchanger of the ORC system, and the heat exchanger evaporating the working medium;

measuring a condensation pressure of the working medium upstream of the pump at a location between a condenser of the ORC system and the pump and a live steam pressure of the working medium downstream of the pump at a location between the heat exchanger and an expander of the ORC system;

determining a setpoint value of a rotational speed of the pump from an inverted performance map of the pump, the inverted performance map of the pump being a relation between a differential pressure across the pump and a rotational speed of the pump for a particular flow rate of the pump, wherein the setpoint value of the flow rate and a difference between the live steam pressure and the condensation pressure are incorporated into the inverted performance map as input values; and setting the rotational speed of the pump to the setpoint value of the rotational speed, wherein an influence of fluctuations of the difference between the live steam pressure and the condensation pressure on the flow rate is compensated by determining the setpoint value of the rotational speed of the pump and setting the rotational speed of the pump to the setpoint value, thereby stabilizing process parameters including at least one selected from the group consisting of (i) the live steam pressure, and (ii) a live steam temperature.

2. The method according to claim 1, wherein the fixing of the setpoint value of the flow rate comprises the following steps:

determining a time average value of the difference between the live steam pressure and the condensation pressure; and fixing the setpoint value of the flow rate from a performance map of the pump, the time average value of the difference between the live steam pressure and the condensation pressure as well as a current rotational speed of the pump being incorporated into the performance map as input values, the performance map of the pump being a relation between the flow rate of the pump and the differential pressure across the pump for a particular rotational speed of the pump.

3. The method according to claim 2, wherein the time average value of the difference between the live steam pressure and the condensation pressure is determined from a first time average value of the condensation pressure and a second time average value of the live steam pressure.

4. The method according to claim 2, wherein the performance map defines at various rotational speeds a relation between the flow rate and a pumping head of the pump, and the pumping head is determined from the differential pressure between the measured live steam pressure and the measured condensation pressure.

5. The method according to claim 4, wherein a density of the working medium is used as a constant predetermined value.

6. The method according to claim 4, wherein the pumping head H is determined from $H=(p_2-p_1)/(\rho \cdot g)$, where $p_1$ stands for the measured condensation pressure, $p_2$ for the measured live steam pressure, $\rho$ for a density of the working medium, and g is a standard acceleration due to gravity.

7. The method according to claim 4, wherein the method comprises the additional step of measuring a temperature of the working medium, and a density of the working medium is ascertained from a functional dependence of the density of the working medium on the temperature or from a table, wherein the measuring of the temperature comprises averaging of the temperature of the working medium over a predetermined time interval.

8. The method according to claim 2, wherein the fixed setpoint value of the flow rate and an unaveraged difference between the live steam pressure and the condensation pressure are incorporated into the inverted performance map as input values to determine the setpoint value of the rotational speed of the pump.

9. The method according to claim 8, wherein the setting of the rotational speed of the pump to the setpoint value of the rotational speed comprises the output of a correction signal onto a control signal supplied to the pump, the control signal being based on the time average value of the difference between the live steam pressure and the condensation pressure and the correction signal being based on the unaveraged difference between the live steam pressure and the condensation pressure.

10. The method according to claim 1, wherein the step of determining the setpoint value of the rotational speed of the pump comprises the following additional steps:

checking whether a combination of the rotational speed of the pump, the fixed setpoint value of the flow rate and the difference between the live steam pressure and the condensation pressure lies within a performance map limit;

setting the rotational speed of the pump to the setpoint value of the rotational speed, if the combination lies within the performance map; and setting the rotational speed of the pump to a safety value, if the combination lies outside the performance map.

11. The method according to claim 10, wherein the safety value is chosen such that the deviation from the setpoint value of the flow rate is as small as possible.

12. The method according to claim 10, wherein the setting of the rotational speed of the pump to the setpoint value of the rotational speed comprises an output of a correction signal onto a control signal supplied to the pump, and wherein a minimum control signal is outputted as a correction signal.

13. The method according to claim 1, wherein the condensation pressure and the live steam pressure of the working medium are measured continuously.

14. The method according to claim 1, wherein the flow rate is defined as a volume flow or as a mass flow of the working medium through the pump.

15. An Organic Rankine Cycle (ORC) system comprising:

a pump for pumping a working medium to a heat exchanger of the ORC system, the heat exchanger evaporating the working medium, and a device for controlling the pump during pumping of the working medium the device comprising:

a first pressure meter for measuring a condensation pressure of the working medium upstream of the pump at a location between a condenser of the ORC system and the pump;

a second pressure meter for measuring a live steam pressure of the working medium downstream of the pump at a location between the heat exchanger and an expander of the ORC system; and a control unit for fixing a setpoint value of a flow rate of the pump; for determining a setpoint value of a rotational speed of the pump from an inverted pump performance map stored in a memory, the inverted performance map of the pump being a relation between a differential pressure across the pump and a rotational speed of the pump for a particular flow rate of the pump, wherein the fixed setpoint value of the flow rate and a difference between the a live steam pressure and the condensation pressure are incorporated into the inverted performance map as input values; and for setting the flow rate of the pump to the setpoint value of the flow rate, wherein an influence of fluctuations of the difference between the live steam pressure and the condensation pressure on the flow rate is compensated by determining the setpoint value of the rotational speed of the pump and setting the rotational speed of the pump to the setpoint value, thereby stabilizing process parameters including at least one selected from the group consisting of (i) the live steam pressure, and (ii) a live steam temperature.

16. The ORC system according to claim 15, wherein the control unit is also suitable for determining a time average value of the difference between the live steam pressure and the condensation pressure; and for fixing the setpoint value of the flow rate from a performance map of the pump, the performance map of the pump being a relation between the flow rate of the pump and the differential pressure across the pump for a particular rotational speed of the pump wherein the time average value of the difference between the live steam pressure and the condensation pressure as well as a current rotational speed of the pump are incorporated into the performance map as input values.

17. The ORC system according to claim 16, wherein the fixed setpoint value of the flow rate and an unaveraged difference between the live steam pressure and the condensation pressure are incorporated into the inverted performance map as input values to determine the setpoint value of the rotational speed of the pump.

18. The ORC system according to claim 17, wherein the control unit is configured for outputting a control signal to the pump, and the setting of the rotational speed of the pump to the setpoint value of the rotational speed comprises the output of a correction signal onto the control signal supplied to the pump; the control signal being based on the time average value of the difference between the live steam pressure and the condensation pressure and the correction signal being based on the unaveraged difference between the live steam pressure and the condensation pressure.

19. The ORC system according to claim 15, wherein the performance map defines at various rotational speeds a relation between the flow rate and a pumping head of the pump, and wherein the control unit is additionally configured for determining a pumping head h from $h=(p_2-p_1)/(\rho \cdot g)$, where $p_1$ stands for the measured condensation pressure, $p_2$ for the measured live steam pressure, $\rho$ for the density of the working medium, and g is the standard acceleration due to gravity.

20. The ORC system according to claim 19, further comprising:

a temperature measuring device for measuring a temperature of the working medium and for transmitting a temperature measurement signal to the control unit;

wherein the control unit is additionally configured for determining a density of the working medium from the temperature measurement signal and for ascertaining the density of the working medium from a functional dependence of a density on the temperature or from a table stored in the memory.

* * * * *